US005785087A

United States Patent [19]

Takahashi et al.

[11] Patent Number: 5,785,087

[45] Date of Patent: Jul. 28, 1998

[54] WATER HYDRAULIC PROPORTIONAL CONTROL VALVE

[75] Inventors: Tamami Takahashi, Tokyo; Yuichi Usami, Kanagawa-ken, both of Japan

[73] Assignee: Ebara Corporation, Tokyo, Japan

[21] Appl. No.: 829,936

[22] Filed: Apr. 1, 1997

[30] Foreign Application Priority Data

Apr. 3, 1996 [JP] Japan ..... 8-081530

[51] Int. Cl.[6] ..... F15B 13/044

[52] U.S. Cl. ..... 137/625.65; 137/238; 137/339; 137/554

[58] Field of Search ..... 137/238, 554, 137/625.65, 339

[56] References Cited

U.S. PATENT DOCUMENTS

| | | | |
|---|---|---|---|
| 3,370,613 | 2/1968 | Weaver . | |
| 4,056,126 | 11/1977 | Hauser et al. | 137/625.69 X |
| 4,406,307 | 9/1983 | Loup et al. | 137/625.65 |
| 4,538,645 | 9/1985 | Perach | 137/625.65 |
| 4,809,749 | 3/1989 | Ichihashi | 137/625.65 |
| 4,844,122 | 7/1989 | Ichihashi | 137/625.65 |
| 4,960,365 | 10/1990 | Horiuchi | 137/625.65 X |
| 4,971,114 | 11/1990 | Ichihashi et al. | 137/625.65 |
| 4,971,116 | 11/1990 | Suzuki et al. | 137/625.65 |
| 5,174,338 | 12/1992 | Yokota et al. | 137/625.65 X |
| 5,186,213 | 2/1993 | Urata et al. | 137/625.61 |
| 5,605,178 | 2/1997 | Jennins | 137/625.65 |

FOREIGN PATENT DOCUMENTS

| | | | |
|---|---|---|---|
| 39 26 846 | 2/1991 | Germany . | |
| 60-231081 | 11/1985 | Japan | 137/625.65 |
| 62-141383 | 6/1987 | Japan | 137/625.65 |
| 63-208911 | 8/1988 | Japan . | |
| 1-145 404 | 6/1989 | Japan . | |
| 3-282080 | 12/1991 | Japan | 137/339 |

*Primary Examiner*—Gerald A. Michalsky
*Attorney, Agent, or Firm*—Oblon, Spivak, McClelland, Maier & Neustadt, P.C.

[57] ABSTRACT

A water hydraulic proportional control valve comprising: a valve body having a supply port, a control port and a return port; a spool axially movably disposed in the valve body for changing a direction of the working fluid and a flow rate of the working fluid; a direct driving mechanism which directly converts electric signals into a driving force for moving the spool, the valve opening of the control valve is controlled by means of a proportional control of the amount of a displacement of the spool from a neutral position thereof toward one direction or another according to an input signal supplied to the direct driving mechanism; spool side chambers provided on both sides of the spool; and drain channels formed in communication to each of the spool side chambers; wherein a water is used as the working fluid, and a flow passages is provided for introducing a pressurized fluid into said spool side chambers, whereby water filling the chamber is constantly replaced by a fresh water thereby preventing generation of microorganisms and decay of the water.

17 Claims, 7 Drawing Sheets

INPUT SIGNAL
DEVIATION SIGNAL
CONTROLLER
14
EXCITATION CURRENT
DISPLACEMENT SIGNAL
1
2
3
4
5
6
7
8
9
10
11
12
13
15
16
Cr
Ps
Pc
Cl

WATER HYDRAULIC PROPORTIONAL CONTROL VALVE

BACKGROUND OF THE INVENTION

The present invention relates to a hydraulic control device which uses water as a working fluid, and more particularly to a hydraulic control valve which controls a flow rate and/or, pressure, of water as a working fluid.

Hitherto, in systems which use fluid as a pressure medium to transmit and control motive power, mineral oil has been widely used as the working fluid. However, when mineral oil is used as a working fluid, problems arise such as contamination of the environment due to oil leakage and fire hazards. In contrast to such hydraulic systems using a mineral oil, in recent years there have been proposed hydraulic systems which use clear water as the working fluid. Such systems are being put to practical use.

However, since the properties of water are markedly different from those of mineral oil, a hydraulic system using water cannot be realized by simply replacing the oil with water in a conventional oil hydraulic system. Since water provides less lubrication than oil, problems arise such as biting or eccessive friction between sliding members of hydraulic devices. Further, problems arise such as corrosion of the device, generation of microorganisms in the water, and decay or rotting of the water itself.

Accordingly, in order to realize a water hydraulic system, problems inherent to water such as those described above must first be solved, while preserving the basic mechanical construction of the oil hydraulic system, as far as possible.

Generally, in control valves adopted in conventional water hydraulic systems, and particularly in spool-type control valves in which highly precise positioning and high slidability are required, two types of valve are employed. The first type uses materials which posses self-lubricating properties for sliding members. Such a valve has the same structure as conventional oil hydraulic control valves, and allows the use of water by selecting an appropriate material for the sliding members thereof. The second type is a control valve wherein the sliding members are caused to slide smoothly by means of forced water lubrication as shown, for example, in Japanese Patent Publication NO. 5-42563.

Now, a conventional water hydraulic proportional control valve using materials which posses self-lubricating properties will be described with reference to FIG. 7. The water hydraulic proportional control valve 1 comprises a flow rate control section (A), a spool driving mechanism (B), and a displacement detection section (C) connected in series to each other.

The flow rate control section (A) includes a valve body 2, a sleeve 3 provided with ports and channels for working fluid and fixed within the valve body 2, and a spool 4 which slides within the sleeve 3. The direction of flow of water is switched by shifting the spool 4 from a neutral position thereof toward one direction or another within the sleeve 3. Also, the flow rate or pressure of water can be adjusted by accurately positioning the spool 4 and thereby adjusting the opening ratio (i.e. valve opening) of the channel from a supply port 7 to a control port 8.

The spool driving mechanism (B) employs an electromagnetic proportional solenoid 10 which generates a driving force proportional to a current supplied thereto. One end of a plunger 11 within the proportional solenoid 10 is linked to the spool 4 of the flow rate control section (A), so that the force generated by the proportional solenoid 10 is directly transmitted to the spool 4.

A core 13 of the displacement sensor 12 is connected to the other end of the plunger 11 of the proportional solenoid 10, to form an axially extending portion from and integral with the spool 4 and the plunger 11, thus the position of the spool 4 can be detected by sensing the position of the core 13.

The spool 4 is urged leftwardly by a spring 5 provided at the outer end of the spool 4. Therefore, in FIG. 7, the spool 4 is moved rightwardly by supplying a current to the proportional solenoid 10, and is moved leftwardly with the force of the spring 5 by reducing the current supplied to the solenoid 10. Control of the spool 4 position is performed by means of feedback control using a reference signal and an actual position signal of the spool 4 detected by the displacement sensor 12.

The spool 4 and the sleeve 3 are formed of materials having self-lubricating properties, such as tungsten carbite, zirconia, alumina, and the like, or altenatively, the surfaces thereof can be coated with such materials.

With the water hydraulic control valve 1 of the above-described construction, drain holes or channels 6 led to a return port 9 are provided in communication to the chambers Cl and Cr provided on both sides of the spool 4 of the valve body 2, so that the capacity of the chambers Cl and Cr may change by moving the spool 4 within the sleeve 3.

Thus, the water filled within the chambers Cl and Cr provided on both sides of the spool 4 of the above described conventional water hydraulic control valve 1 flows into one chamber and flows out of the other chamber via the drain channel 6 by moving the spool 4. However, the water flowed into the drain channel 6 from the chambers Cl and Cr flows back into the chambers Cl and Cr from the drain channel 6 when the spool 4 moves in the opposite direction. Thus, there is no constant flow through the chambers Cl and Cr. Therefore, problems such as generation of microorganisms and decay of the water arise at these portions, due to the difficulty of replacing the water filled in the chambers Cl and Cr with a fresh water.

Further, the performance of the electromagnetic proportional solenoid 10 which serves as a spool driving mechanism is lowered due to heat generated by the solenoid.

SUMMARY OF THE INVENTION

It is therefore an object of the present invention to provide a water hydraulic proportional control valve which is capable of preventing the generation of microorganisms and decay of the water within the control valve.

Another object of the present invention is to provide a water hydraulic proportional control valve which is capable of preventing a change in properties of the electromagnetic proportional solenoid for driving the valve spool due to the temperature change of the solenoid while fulfilling the aforementioned object.

According to the first aspect of the present invention, there is provided a water hydraulic proportional control valve comprising: a valve body having a supply port, a control port and a return port; a spool axially movable disposed in the valve body for changing a direction of the working fluid and a flow rate of the working fluid; a direct driving mechanism which directly converts electric signals into a driving force for moving the spool, the valve opening of the control valve is controlled by means of a proportional control of the amount of a displacement of the spool from a neutral position thereof toward one direction or another according to an input signal supplied to the direct driving mechanism; spool side chambers provided on both sides of the spool; and drain channels formed in communication to each of the spool side chambers; wherein water is used as the working fluid, and a flow passage is provided for introducing a pressurized fluid into said spool side chambers.

The aforementioned direct driving mechanism may preferably be an electromagnetic proportional solenoid.

According to a second aspect of the present invention, the direct driving mechanism is an electromagnetic proportional solenoid having two spaces separated by a plunger provided axially movably within the electromagnetic proportional solenoid, wherein one of the drain channels is formed in communication to one of the two spaces of the solenoid which is positioned on the opposite side of the spool of the control valve.

According to a third aspect of the present invention, the water hydraulic proportional control valve further comprises a displacement sensor connected to the electromagnetic proportional solenoid for detecting a position of the spool, the sensor includes two spaces separated by a core provided axially movably within the sensor, wherein one of the drain channel is formed in communication to one of the two spaces of the sensor which is positioned on the opposite side of the spool of the control valve.

According to a fourth aspect of the present invention, the pressurized fluid is introduced into each of the spool side chambers through an orifice provided in the flow passage from the supply port of the control valve.

According to a fifth aspect of the present invention, hydrostatic bearings are disposed in the valve body and are positioned within the flow passage supplying the pressurized water for supporting the spool, the aforementioned orifice is formed in each of the hydrostatic bearings.

According to a sixth aspect of the present invention, in the water hydraulic proportional control valve of the fifth aspect described above, a further orifice is provided in the drain channel on the downstream of the orifice formed in the hydrostatic bearing on the opposite side of the solenoid.

The further orifice may be of the type wherein a flow resistance can be adjusted.

According to a further aspect of the present invention, in the water hydraulic proportional control valve of the fifth aspect described above, a further orifice having equal flow resistance is provided in the drain channel on downstream of the each orifice formed in the hydrostatic bearings.

The further orifice may be of the type wherein a flow resistance can be adjusted.

Pressurized fluid is introduced via a fluid passage into the chambers on both sides of the spool where water serving as a working fluid tends to stagnate and is then returned to a tank via the drain channels. Thus, water filling the chambers is constantly replaced by fresh water, thereby preventing generation of microorganisms and decay of the water, the replacement of the water further discharges dust and the like to the outside of the valve thereby preventing collection of such foreign materials. Also, the water absorbs the heat generated by the solenoid, providing cooling thereto, and thereby preventing a change in the solenoid properties resulting from temperature changes.

The above and other objects, features and advantages of the present invention will become more apparent from the following description when taken in conjunction with the accompanying drawings in which preferred embodiments of the present invention are shown by way of illustrative examples.

PREFERRED EMBODIMENTS OF THE INVENTION

Figure 1:
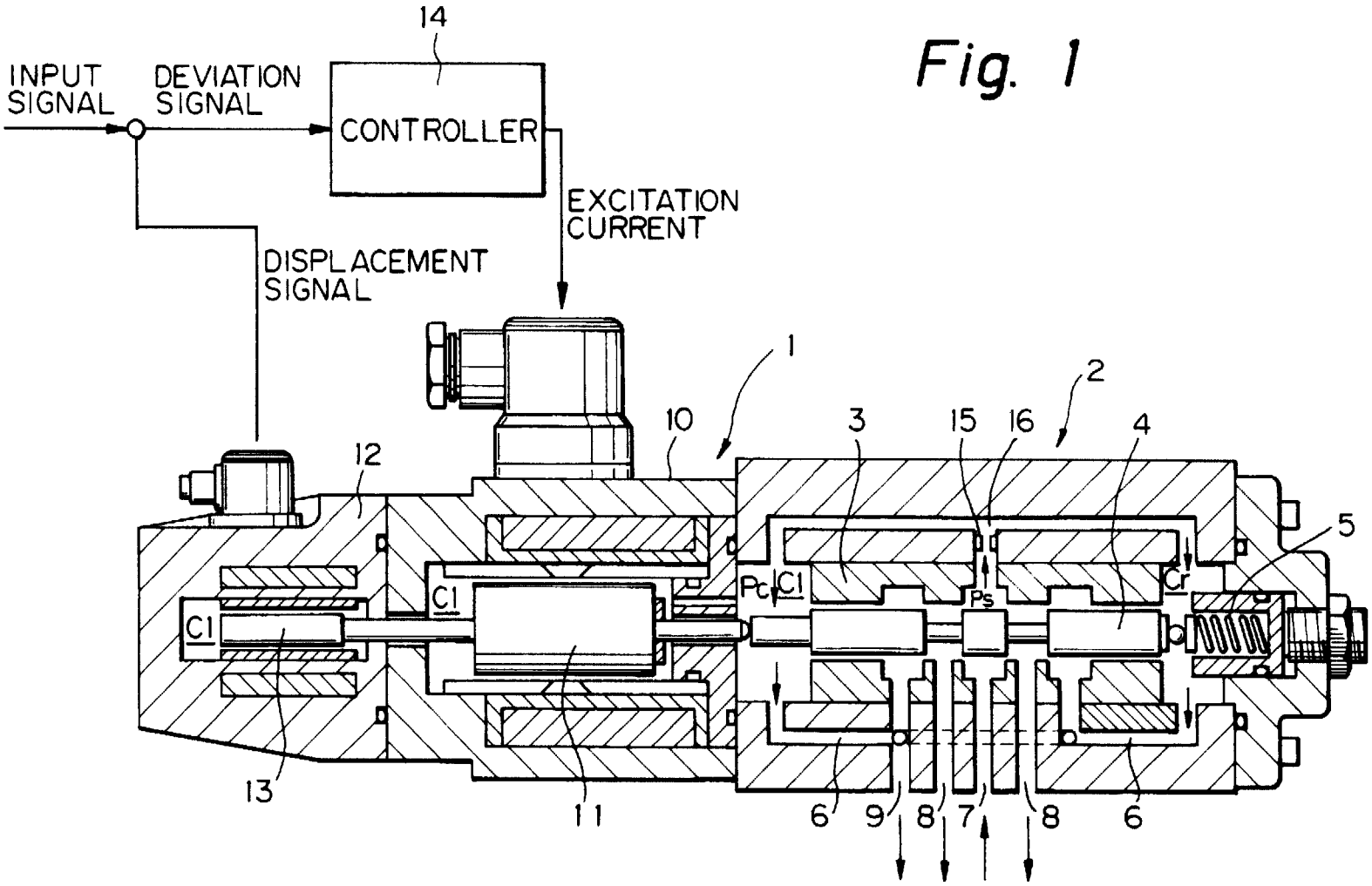
FIG. 1 is a longitudinal sectional view of the water hydraulic proportional control valve according to the first embodiment of the present invention.

FIG. 1 illustrates a first embodiment of the water hydraulic proportional control valve according to the first embodiment of the present invention. In FIG. 1, the hydraulic control valve 1 is comprised of a valve body 2, a sleeve 3 fixed within the valve body 2, a spool 4 disposed slidably within the sleeve 3, an electromagnetic proportional solenoid 10 connected to the valve body 2 and presses the spool 4 in the axial direction, a spring 5 interposed between the right end of the spool 4 and the valve body 2 and opposes to the force generated by the electromagnetic proportional solenoid 10, and a displacement sensor 12 connected to the solenoid 10 for detecting displacement of the spool 4. A plurality of ports, e.g. a supply port 7, control ports 8, and a return port 9, for switching the channel of the water supplied are provided in the valve body 2 and the sleeve 3. The spool 4 is displaced from the neutral position toward one direction or another sliding within the sleeve 3, and switches the channel of the working fluid. The opening ratio (valve opening) of the channel is continuously changed by positioning the spool 4 at an arbitrary position within the sleeve 3, thus changing the direction of flow, and allowing continuous control of a flow rate or pressure.

The interior of the electromagnetic proportional solenoid 10 for pressing the spool 4 in the axial direction and the displacement sensor 12 is in contact with the water. Accordingly, these members are made of rust-proof material, such as stainless steel or plastic, for example, as countermeasures for rusting.

Figure 7:
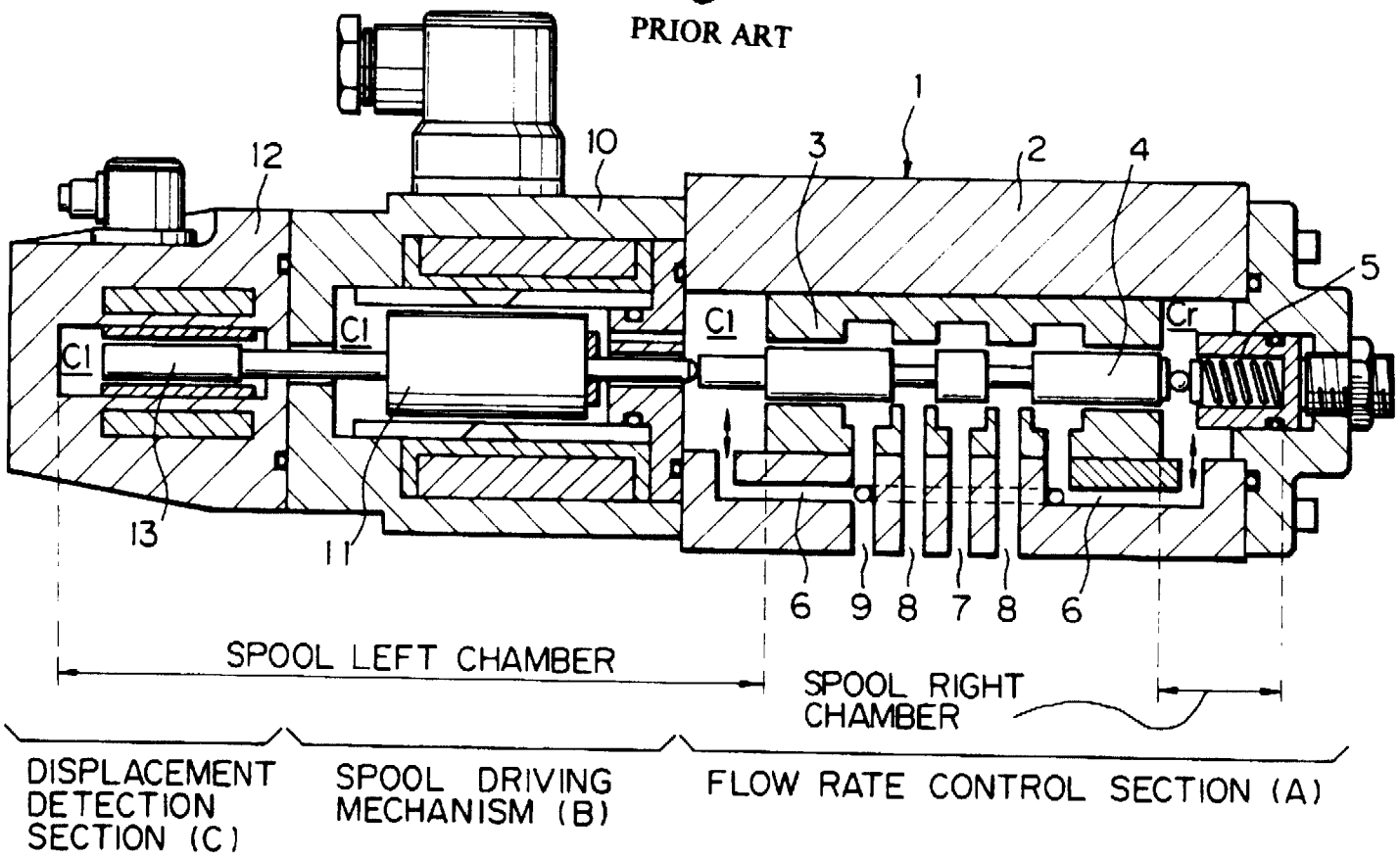
Fig. 7 PRIOR ART
FIG. 7 is a longitudinal sectional view of a conventional water hydraulic proportional control valve.

When a signal for the reference position of the spool 4 is input from the input terminal, a deviation signal is created from the reference position signal and the actual spool position signal fed back from the displacement sensor 12, and this deviation signal is input to the controller 14 of the proportional solenoid 10. The controller 14 directly amplifies the deviation signal, and integrates the deviation signal and provides excitation current to the solenoid 10 so as to balance with the resilient force of the spring, thus positioning the spool 4 at the reference position. The above arrangement is not particularly different from that of a conventional water hydraulic control valve stated above with reference to FIG. 7.

In the present embodiment, the control valve 1 is arranged in such a way that the spool 4, the plunger 11 of the proportional solenoid 10, and the core 13 of the displacement sensor 12 are sequentially linked, drain channels 6 are formed in communication to the chambers Cl and Cr on both sides of the spool 4 of the valve body 2, and flow passage 16 is provided to introduce pressurized water from the supply port 7 of the control valve 1 to each of the chambers Cl and Cr via an orifice 15. The drain channels 6 are connected to a return port 9. Thus, a constant flow of water is formed by introducing pressurized fluid, since the pressure Ps upstream the flow passage 16, the pressure Pc, Pr within the chambers, and the pressure Pt in the return port 9 sequentially becomes lower.

The orifice 15 is provided in the flow passage 16 to prevent excessive flow of the water to be introduced into the chambers Cl and Cr on both sides of the spool. In order to prevent generation of microorganisms and decay of the water in the valve, the water must constantly flow, but a very low flow rate is sufficient. Also, by providing the orifice 15, supplied pressure is not directly placed on the chambers Cl and Cr on both sides of the spool, so that each chamber can be maintained at a low pressure. Thus, the displacement sensor 12, solenoid 10, valve body 2 and the like do not need to be designed for high pressure.

Figure 2:
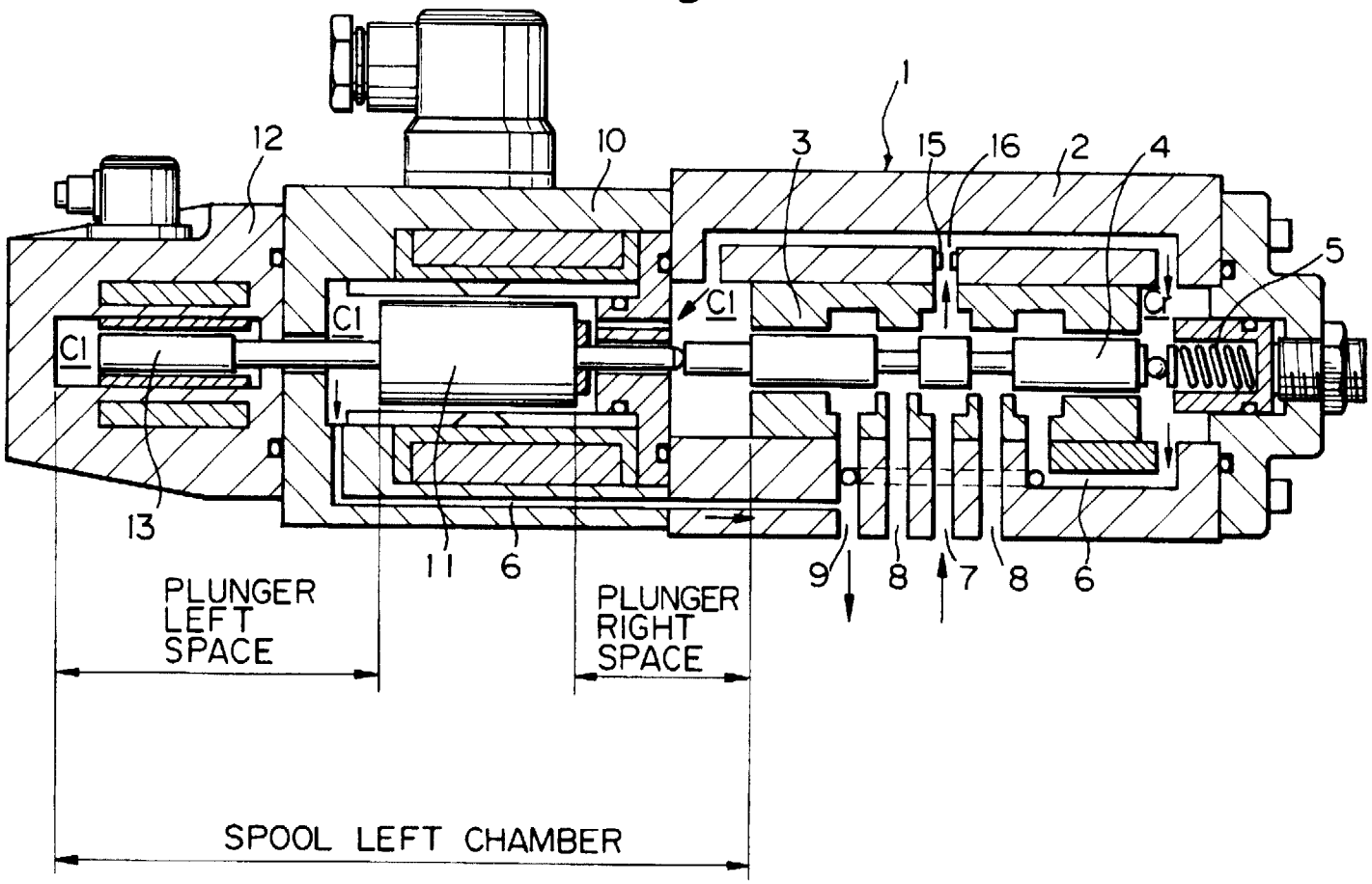
FIG. 2 is a longitudinal sectional view of the water hydraulic proportional control valve according to the second embodiment of the present invention.

FIG. 2 illustrates a second embodiment of the water hydraulic proportional control valve according to the present invention. In this embodiment, one of the drain channels 6 is formed in communication to one space Cl of the two spaces separated by a plunger 11 within the solenoid 10, the one space Cl being on opposite side of the spool 4. By forming the drain channel 6 in such a way, water flows passing through the flow passage 16, the chamber Cl at the end of the spool 4, the interior of the solenoid 10 including the space Cl, and to the drain channel 6.

By causing the water to pass through the interior of the solenoid 10, it not only prevents generation of microoganisms and decay of the water within the solenoid 10 and the valve body 2, but also allows for the water to absorb the heat generated by the solenoid 10, and thereby cool the solenoid 10. The amount of heat generated by the solenoid 10 is great, since the solenoid 10 constantly generates a force to counter the force of the spring 5. It is known that a temperature change in the solenoid 10 reduces linearity of the force generated thereby. Accordingly, by cooling the solenoid 10, the solenoid 10 can be maintained at a low temperature and the temperature change thereof can be maintained at a low level, thus allowing for the control valve performance to be kept stable.

Figure 3:
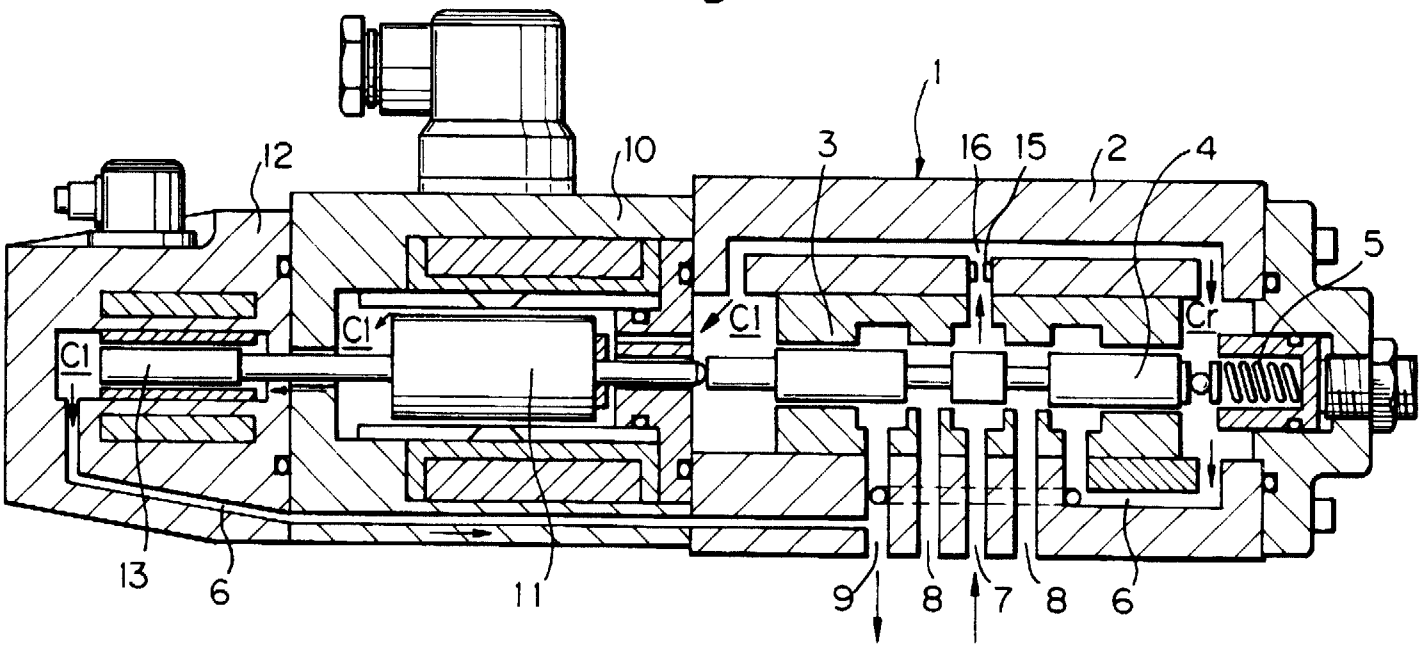
FIG. 3 is a longitudinal sectional view of the water hydraulic proportional control valve according to the third embodiment of the present invention.

FIG. 3 illustrates a third embodiment of the water hydraulic proportional control valve according to the presnet invention. In this embodiment, one of the drain channel 6 is formed in communication to one space Cl of the two spaces separated by a core 13 provided within the displacement sensor, the one space Cl being on opposite side of the spool 4. Accordingly, water constantly flows through the interior of the solenoid 10 and displacement sensor 12 linked to one end of the spool 4, thus preventing generation of microoganisms and rotting or decay of the water in the spaces within the sensor 12 and the solenoid 10 in addition to chambers Cl and Cr of the valve.

Figure 4:
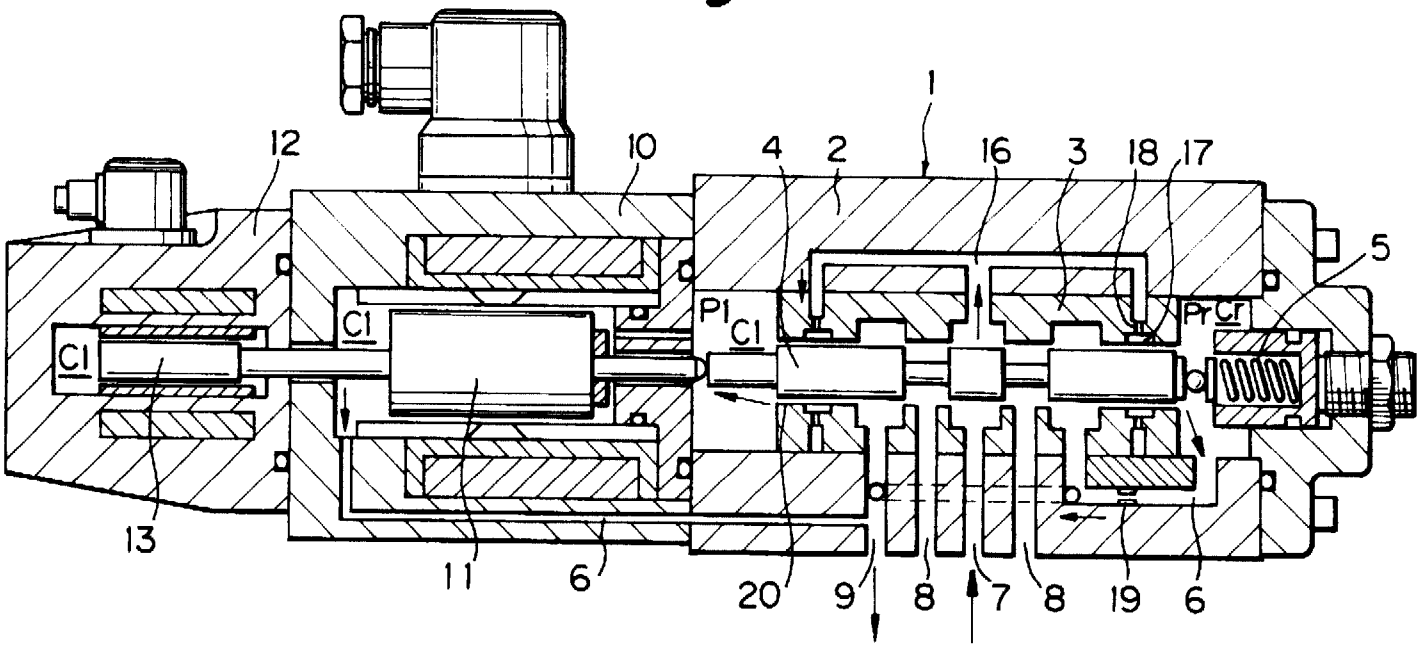
FIG. 4 is a longitudinal sectional view of the water hydraulic proportional control valve according to the fourth embodiment of the present invention.

FIG. 4 illustrates a fourth embodiment of the water hydraulic proportional control valve according to the present invention. In this embodiment, hydrostatic bearings 17 are formed in the sleeve 3 so that they are in communication to the flow passage 16, whereby the spool 4 is supported in a non-contacting manner by introducing the pressurized water supplied from the pump through the supply port to the hydrostatic bearings 17 and further applying it to the spool 4 via an orifice 18 formed in hydrostatic bearings 17. By using such hydrostatic bearings 17, the spool 4 can be smoothly moved within the sleeve 3 even using water of low lubricating properties as the working fluid.

Water flowing in the hydrostatic bearings 17 formed in the sleeve 3 passes through the gap between the spool 4 and the sleeve 3 and is divided into two flows, i.e. one flow or inward flow to the return port 9 of the sleeve 3, and the other flow or outward flow to the chambers Cl and Cr on both sides of the spool 4. Water which has flowed to the chambers Cl and Cr on both sides of the spool 4 passes through drain channels 6 formed in communication to the spool end chamber and the space within the solenoid 10 and flows out to the return port 9.

Now, even if hydrostatic bearings are used, unless drain channels are provided in communication to both chambers, the water does not flow outwardly from the hydrostatic bearings to both chambers but rather only flows inwardly to the tank port or return port 9. Thus, if the drain channels are not provided, the change in capacity of both chambers due to the movement of the spool is allowed by flowing of water in and out of both chambers through the gap between the spool 4 and the sleeve 3. This is caused because the gap between the spool and sleeve is formed to be relatively wide since it is necessary to have a certain amount of flow to obtain the effects of the hydrostatic bearings.

Accordingly, taking only the operation of the control valve into consideration, such drain channels are not necessarily required. However, it is important that a constant flow be formed from the hydrostatic bearings to the chambers on both sides of the spool by providing the drain channels, to deal with the problems such as generation of microorganisms, decay of the water, and the like.

However, when the hydrostatic bearings 17 are used and the drain channel 6 is formed in communication to the space Cl of the two spaces divided by the plunger 11 of the proportional solenoid 10, the gap between the plunger 11 and the solenoid 10 acts as a throttle or resistance, and a deviated force may be placed upon the spool 4. This is because the pressure on the side of the solenoid 10 of the spool 4 becomes greater than pressure on the side of the spring 5. This operation will be described hereinbelow with reference to FIG. 5.

By causing the pressurized water to pass from the flow passage 16 through the drain channel 6 formed in communication to the space Cl of the solenoid 10 to the return port 9, the generation of microorganisms, rotting of the water, and accumulation of dust particles and the like can be prevented, and further the solenoid 10 is cooled.

The pressurized water flowing out of the hydrostatic bearings 17 passes through the gap 20 between the spool 4 and the sleeve 3. In this case, since the flow of water to both chambers Cl and Cr is restricted by this gap 20, there is no excessive flow. Accordingly, the effects of the present invention stated above can be obtained with a slight flow by adjusting the gap 20 between the spool 4 and the sleeve 3, even when the hydrostatic bearings 17 are used.

Figure 5:
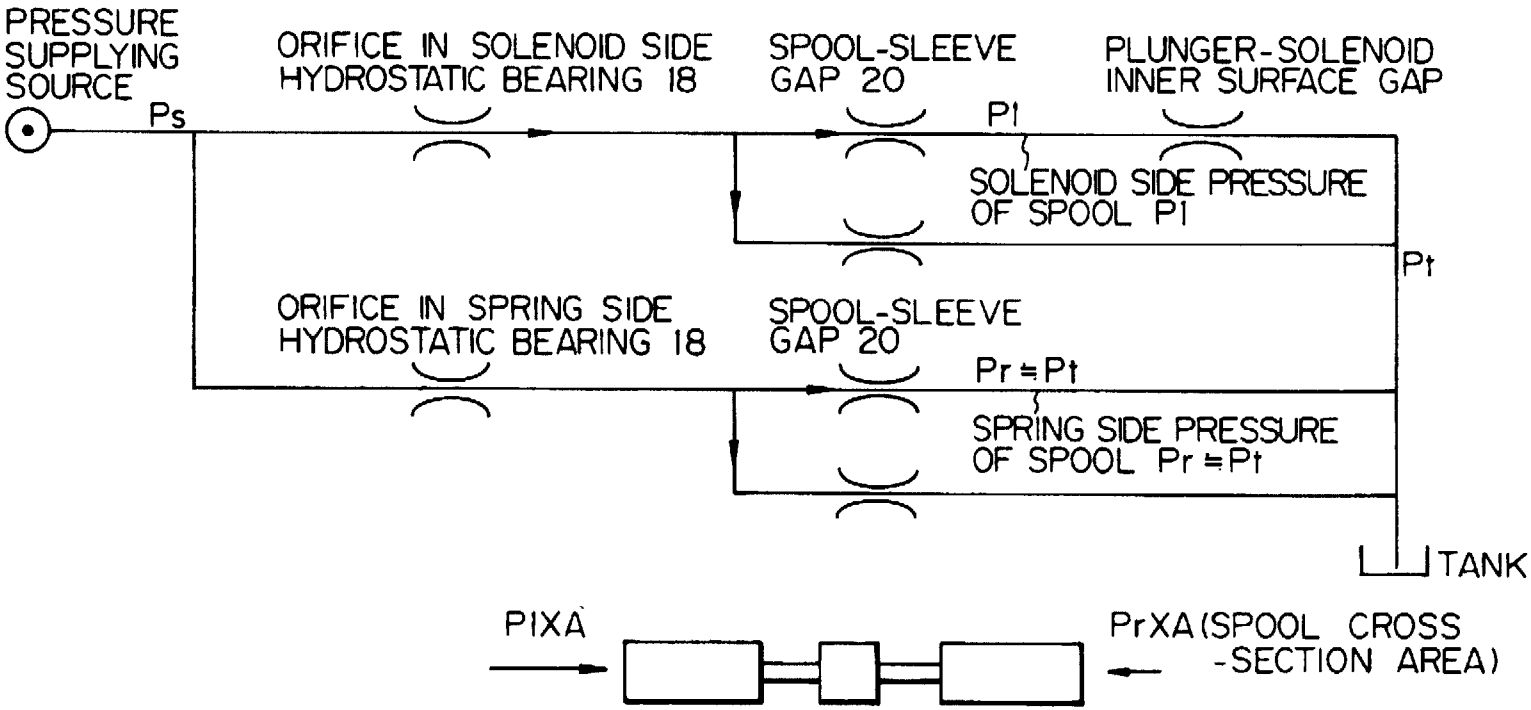
FIG. 5 is an explanatory diagram describing the pressure applied to the various portions of the control valve in the event that a hydrostatic bearing being used.

FIG. 5 is a diagram explaining the pressure applied to various portions of the control valve when hydrostatic bearings are used. The pressurized water from the supply port is split and flows to the hydrostatic bearings 17 which support both ends of the spool 4, passes through the orifices 18 in the bearings and flows out to the gap 20 between the spool 4 and the sleeve 3. Water which has flowed out of each gap flows on the one hand inwardly to the tank port 9 and on the other hand outwardly to the chambers Cl and Cr on both sides of the spool. Water which has flowed to the chamber Cr on the spring side flows to the drain channel 6 directly connected to the tank port 9, and water which has flowed to the chamber Cl on the solenoid side flows to the drain channel 6 via the gap between the outer surface of plunger 11 and the inner wall of the solenoid 10. However, this gap provides throttle or resistance and raises the pressure in the chamber Cl on the solenoid 10 side of the spool 4, causing the force which presses the spool 4 in the direction toward the spring 5. In the event that such an unbalance force owing to the pressure difference on both sides of the spool 4 exceeds the spring force, then the force for pressing the spool 4 toward the solenoid 10 side disappears. Accordingly, the situation arises that the spool 4 cannot be positioned at an arbitrary position, and particularly at a position deviated toward the solenoid 10 side.

Such a pressure difference can be eliminated by making the gap formed between the spool 4 and the sleeve 3 so that it has great resistance on the solenoid 11 side and small resistance on the spring 5 side, i.e., by narrowing the size of the gap on the solenoid 11 side and widening it on the spring 5 side. Also, the pressure difference on both ends of the spool 4 can be reduced by providing an orifice 19 in the drain channel 6 on the spring 5 side. In this case, the size of the orifice 19 is favorably selected so that it has the same resistance as that of the gap formed in the solenoid 11 or gaps formed in the solenoid 11 and displacement sensor 12. The orifice 19 can be constituted in such a way that the resistance thereof is variable. By making the resistance variable, the pressure on the spring 5 side can be adjusted to an appropriate value, while checking the pressure on the solenoid 11 side.

Figure 6:
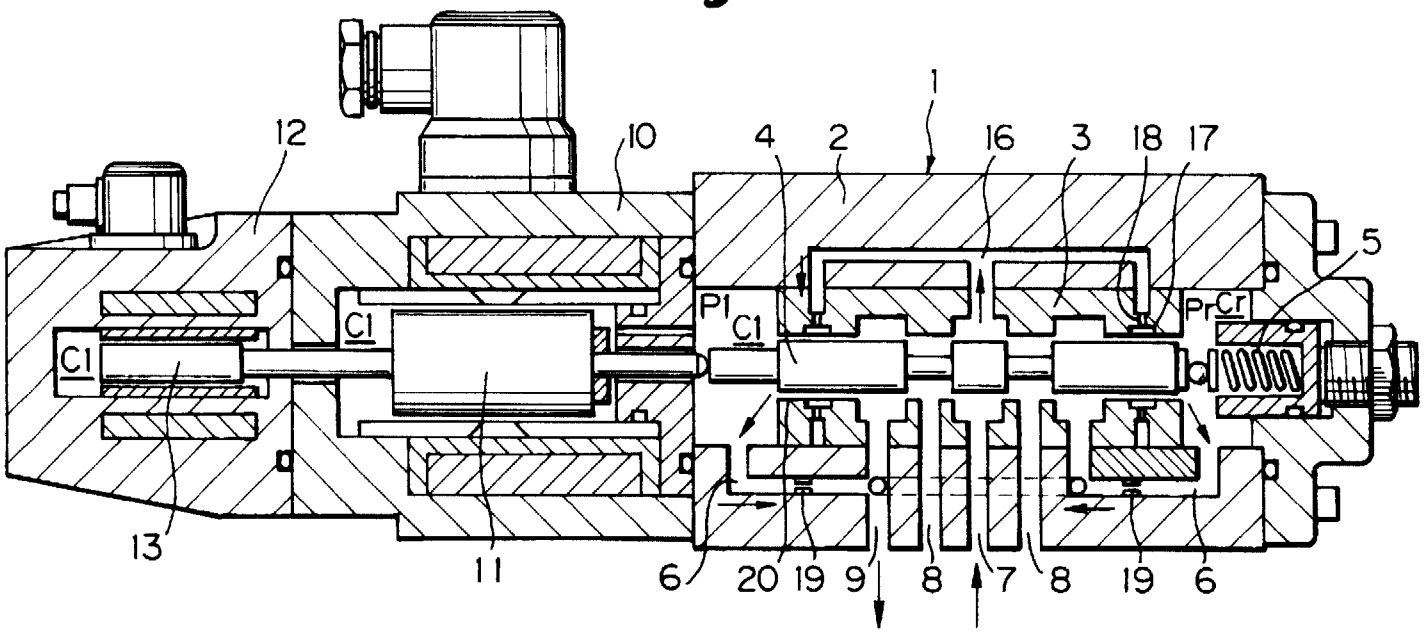
FIG. 6 is a longitudinal sectional view of the water hydraulic proportional control valve according to the fifth embodiment of the present invention.

FIG. 6 illustrates a fifth embodiment of the water hydraulic proportional control valve according to the present invention, wherein the bearing effects of the hydrostatic bearings 17 can be adjusted by providing orifices 19 in the drain channel 6 from the chambers Cl and Cr on both sides of the spool of the valve body 2. That is the load capacity having enough margin is selected beforehand for the hydrostatic bearings 17, and adjustable orifices 19 are provided in the drain channels 6 from the chambers Cl and Cr on both sides of the spool. By adjusting the resistance of these orifices 19 so that the same pressure is obtained on both sides of the spool 4 and the water flow is sufficient to effect the hydrostatic bearing, bearing effect can be obtained with a minimum flow, and at the same time, generation of microorganisms and decay of the water within the chambers Cl, and Cr on both side of the spool can be prevented.

In addition to the above-described water hydraulic proportional control valves comprising flow rate control section, spool driving mechanism, and displacement detection section, there are other types which comprises solenoids provided on both sides of the flow rate control section, which is known as double-side solenoid type. Also, regarding the direct driving mechanism, in addition to the electromagnetic proportional solenoids stated above, there are other types such as combinations of a servo motor and ball screw, combinations of a piezo device and a lever, and so on. The present invention is not limited to the construction of the control valve described above, but can be applied to a control valve having a different construction such as double-side solenoid types and the like.

According to the water hydraulic control valve according to the present invention, constructed as described above, a flow passage is formed for introducing pressurized fluid into the chambers on both sides of the spool, prone to stagnation of water serving as the working fluid, and drain channels are formed in communication to these chambers. Therefore, the water filling the chambers is continuously replaced by fresh water thereby preventing generation of microorganisms, decay of the water, and discharging dust and the like outside of the valve. Also, the water takes the heat generated by the solenoid and flows out, to cool the solenoid, so that change in the solenoid properties due to temperature change can be prevented.

What is claimed is:

1. A water hydraulic proportional control valve comprising: a valve body having a supply port, a control port and a return port; a spool axially movably disposed in said valve body for changing a direction of the working fluid and a flow rate of the working fluid; a direct driving mechanism which directly converts electric signals into a driving force for moving said spool, the valve opening of said control valve is controlled by means of a proportional control of the amount of a displacement of said spool from a neutral position thereof toward one direction or another according to an input signal supplied to said direct driving mechanism; spool side chambers provided on both sides of said spool; drain channels formed in communication to each of said spool side chambers; and a flow passage means separate and distinct from said direct driving mechanism and including passages formed in said valve body extending from said supply port to each of said spool side chambers; wherein a water is used as said working fluid.

2. The water hydraulic proportional control valve claimed in claim 1, wherein said direct driving mechanism is an electromagnetic proportional solenoid.

3. The water hydraulic proportional control valve claimed in claim 2, wherein said water hydraulic proportional control valve further comprises a displacement sensor connected to said direct driving mechanism for detecting a position of said spool, said sensor includes two spaces separated by a core provided axially movably within said sensor, wherein one of said drain channel is formed in communication to one of said two spaces of said sensor which is positioned on the opposite side of said spool of said control valve.

4. The water hydraulic proportional control valve claimed in claim 3, wherein said pressurized fluid is introduced into each of said spool side chambers through an orifice provided in said flow passage of said control valve.

5. The water hydraulic proportional control valve claimed in claim 2, wherein said pressurized fluid is introduced into each of said spool side chambers through an orifice provided in said flow passage of said control valve.

6. The water hydraulic proportional control valve claimed in claim 1, wherein said direct driving mechanism is an electromagnetic proportional solenoid having two spaces separated by a plunger provided axially movably within said electromagnetic proportional solenoid, wherein one of said drain channel is formed in communication to one of said two spaces of said solenoid which is positioned on the opposite side of said spool of said control valve.

7. The water hydraulic proportional control valve claimed in claim 6, wherein said water hydraulic proportional control valve further comprises a displacement sensor connected to said direct driving mechanism for detecting a position of said spool, said sensor includes two spaces separated by a core provided axially movably within said sensor, wherein one of said drain channel is formed in communication to one of said two spaces of said sensor which is positioned on the opposite side of said spool of said control valve.

8. The water hydraulic proportional control valve claimed in claim 7, wherein said pressurized fluid is introduced into each of said spool side chambers through an orifice provided in said flow passage of said control valve.

9. The water hydraulic proportional control valve claimed in claim 6, wherein said pressurized fluid is introduced into each of said spool side chambers through an orifice provided in said flow passage of said control valve.

10. The water hydraulic proportional control valve claimed in claim 1, wherein said water hydraulic proportional control valve further comprises a displacement sensor connected to said direct driving mechanism for detecting a position of said spool, said sensor includes two spaces separated by a core provided axially movably within said sensor, wherein one of said drain channel is formed in communication to one of said two spaces of said sensor which is positioned on the opposite side of said spool of said control valve.

11. The water hydraulic proportional control valve claimed in claim 10, wherein said pressurized fluid is introduced into each of said spool side chambers through an orifice provided in said flow passage of said control valve.

12. The water hydraulic proportional control valve claimed in claim 1, wherein said pressurized fluid is introduced into each of said spool side chambers through an orifice provided in said flow passage of said control valve.

13. The water hydraulic proportional control valve claimed in claim 12, wherein hydrostatic bearings are disposed in said valve body and are positioned within said flow passage supplying said pressurized water for supporting said spool, said orifice is formed in each of said hydrosatic bearings.

14. The water hydraulic proportional control valve claimed in claim 13, wherein a further orifice is provided in said drain channel on the downstream of said orifice formed in said hydrostatic bearing on the opposite side of said solenoid.

15. The water hydraulic proportional control valve claimed in claim 14, wherein a flow resistance of said further orifice can be adjusted.

16. The water hydraulic proportional control valve claimed in claim 12, wherein a further orifice having equal flow resistance is provided in said drain channel on the downstream of said each orifice formed in said hydrostatic bearings.

17. The water hydraulic proportional control valve claimed in claim 16, wherein a flow resistance of said further orifice can be adjusted.

* * * * *